US009826843B1

(12) United States Patent
Tomaszewski et al.

(10) Patent No.: US 9,826,843 B1
(45) Date of Patent: Nov. 28, 2017

(54) STACKABLE SHELF TRAY FOR A RETAIL DISPLAY

(71) Applicant: Sonoco Development, Inc., Hartsville, SC (US)

(72) Inventors: Valentine Tomaszewski, Western Springs, IL (US); Glen Bersamin, New Lenox, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/349,264

(22) Filed: Nov. 11, 2016

(51) Int. Cl.
*B65D 5/00* (2006.01)
*B65D 5/48* (2006.01)
*A47F 5/11* (2006.01)
*A47F 5/00* (2006.01)

(52) U.S. Cl.
CPC ..... *A47F 5/114* (2013.01); *A47F 5/0018* (2013.01); *B65D 5/002* (2013.01); *B65D 5/006* (2013.01)

(58) Field of Classification Search
CPC ..... A47F 5/114; A47F 5/116; B65D 5/006; B65D 5/002
USPC ..... 229/915, 918
See application file for complete search history.

(56) References Cited

U.S. PATENT DOCUMENTS 2,690,285 A * 9/1954 Main ..... B65D 5/2038 206/509
4,231,299 A * 11/1980 Gebhardt ..... A47F 5/116 108/190
4,310,323 A * 1/1982 Moen ..... B31D 5/0004 493/456
5,520,325 A * 5/1996 Quaintance ..... B65D 5/48026 229/120.26
5,950,915 A * 9/1999 Moen ..... B65D 5/48048 229/120.03
6,227,370 B1 * 5/2001 Earnshaw ..... B65D 5/001 206/497
6,378,764 B1 4/2002 Teixidor Casanovas
6,513,705 B1 * 2/2003 Sheffer ..... B65D 5/0025 206/509
6,676,012 B1 * 1/2004 Southwell ..... B65D 5/002 229/120.17
7,066,342 B2 * 6/2006 Baechle ..... B65D 5/006 206/600
7,118,023 B2 10/2006 Holdsworth
7,281,648 B2 * 10/2007 Lowry ..... B65D 5/321 206/511
7,546,927 B2 * 6/2009 Lowry ..... A47F 3/142 206/557
7,637,372 B2 12/2009 Keel et al.
7,823,725 B1 * 11/2010 Shupe ..... B65D 71/0096 206/386
7,861,916 B2 * 1/2011 Little ..... B65D 5/48034 229/120.24
8,567,661 B2 * 10/2013 Sullivan ..... B65D 5/0035 229/120.24
8,833,573 B2 * 9/2014 Tomaszewski ..... B65D 19/385 108/186

(Continued)

*Primary Examiner* — Leslie A Nicholson, III
*Assistant Examiner* — Kimberley S Wright
(74) *Attorney, Agent, or Firm* — Miller, Matthias & Hull LLP

(57) ABSTRACT

A tray and corner post type packaging system for shipping and displaying palletized products is provided. The packaging system is made from three folded and glued blanks and includes four corner posts and a central support.

13 Claims, 9 Drawing Sheets

(56) References Cited

U.S. PATENT DOCUMENTS

| | | | | |
|---|---|---|---|---|
| 8,998,073 | B2 * | 4/2015 | De Beer | B65D 5/002 229/164 |
| 9,428,298 | B2 * | 8/2016 | Bersamin | A47F 5/114 |
| 9,655,446 | B2 * | 5/2017 | Brady | A47B 87/0253 |
| 2006/0151410 | A1 * | 7/2006 | Lowry | A47F 3/142 211/126.16 |
| 2009/0032432 | A1 * | 2/2009 | Kostos | B65D 5/006 206/600 |
| 2010/0084459 | A1 * | 4/2010 | Little | B65D 5/48034 229/120.29 |
| 2013/0319963 | A1 * | 12/2013 | Coon | A47F 5/116 211/149 |
| 2015/0076096 | A1 * | 3/2015 | Brady | A47B 87/0253 211/132.1 |
| 2015/0122690 | A1 * | 5/2015 | Bersamin | A47F 5/114 206/511 |
| 2016/0236810 | A1 * | 8/2016 | Lelay | B65D 5/002 |
| 2016/0368660 | A1 * | 12/2016 | Pfeifer | B65D 19/0012 |

* cited by examiner

STACKABLE SHELF TRAY FOR A RETAIL DISPLAY

BACKGROUND OF THE INVENTION

Field of the Invention

This patent relates to a tray and corner post type packaging system for shipping and displaying palletized products. More particularly, this patent relates to a unique shelf tray for use as a component of a pallet display, the shelf tray including a central support and four corner supports and easily assembled from a single structure made from three blanks adhered together.

Description of the Related Art

Pallet displays are display structures that can be used to ship products on a pallet and then display the products in a retail setting. Pallet displays having multiple shelves for supporting products are well known. Some pallet displays are made of multiple corrugated components and sometimes even require fasteners. Pallet displays can require complex assembly steps, and can be large even when knocked down. The shelves of the pallet displays can sag under the weight of the products. The present disclosure addresses these problems.

BRIEF SUMMARY OF THE INVENTION

The present disclosure relates to a tray and corner post type packaging system for shipping and displaying palletized products is provided. The packaging system is made from three folded and glued blanks and includes four corner posts and a central support. In a first aspect of the disclosure a shelf tray is provided comprising a bottom, corner posts, side walls, end walls and center supports. The bottom may define one or more bottom slots, and has a substantially rectangular periphery comprising two opposing side edges, two opposing end edges and four corners. The corner posts extend upwardly from the four corners of the bottom. Each corner post has a top edge and a height. Each side wall extends upward from a side edge. Each end wall extends upward from an end edge and laterally from one side wall to another side wall. The center supports extend upwardly from the bottom. Each center support has a top edge and a height equal to the height of the corner posts. Each center support may have locator tabs extending upwardly from the top edge and configured to fit into bottom slots of a second shelf tray positioned on top of the shelf tray.

In another aspect of the disclosure a shelf tray comprising a tray member blank and two insert blanks adhered to the tray blank is provided. The tray member blank comprises a bottom having a substantially rectangular periphery comprising two opposing side edges, two opposing end edges and four corners, two side walls, each side wall extending upward from a side edge, two end walls, each end wall extending upward from an end edge and laterally from one side wall to an opposing side wall, a first outer corner post member foldably attached to an end wall and a second outer corner post member foldably attached to a side wall. The first outer corner post member and the second outer post member are foldably attached to each other in an orthogonal configuration along an outer corner edge. Each insert blank comprises a bottom panel adjacent the bottom, a center support extending upwardly from the bottom panel, an end wall panel elongated portion foldably attached to the bottom panel and in flat abutting relationship with the end wall 14, and two corner post inner halves attached to the end wall panel elongated portion and adhered to the first outer corner post member and the second outer corner post member.

In another aspect of the disclosure a method of making a shelf tray is provided. The method may comprise the steps of: positioning each insert blank onto the tray blank so that each first L-shaped inner corner post member is aligned with and adhered to a corresponding first outer corner post member and each second L-shaped inner corner post member is aligned with and adhered to a corresponding second outer corner post member to create a substantially flat, unfolded structure; folding the flat, unfolded structure inwardly along the two opposing end edges and along the four outer corner edges; allowing the first I-shaped inner corner post member and the second I-shaped inner corner post member to extend inwardly away from the outer first outer corner post member and the second outer corner post member along fold line until the first I-shaped inner corner post member, the second I-shaped inner corner post member, the first outer corner post member and the second outer corner post member form a substantially rectilinear, tubular portion of a corner post; folding each inner end panel inwardly along the double end fold line until the inner end panel is in facing, abutting relationship with a corresponding outer end panel and each insert blank is captured therebetween; folding each center support main panel upwardly along a fold line; and folding each center support wing panel inwardly along a fold line to achieve a fully assembly shelf tray.

DETAILED DESCRIPTION OF THE INVENTION

Figure 1:
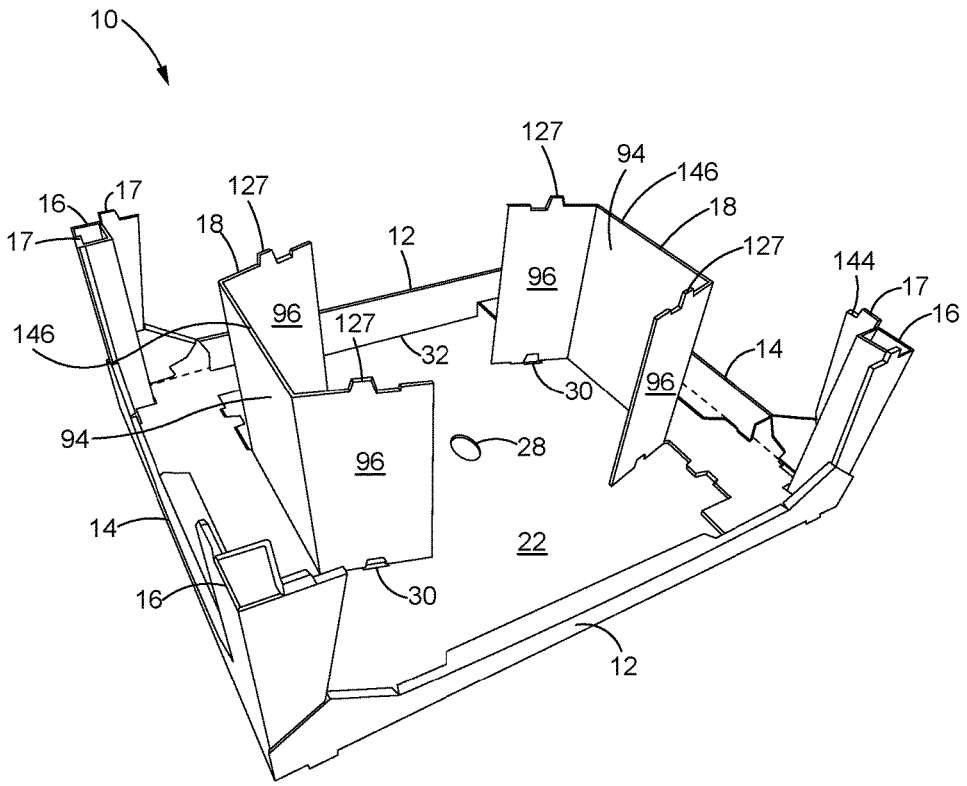
FIG. 1 is perspective view of a shelf tray that can be used as a component of a pallet display.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "top" and "bottom," "front" and "back," (etc.), used as nouns, adjectives or adverbs refer in this description to the orientation of the structure as it is illustrated in the various views. Such terms are not intended to limit the invention to a particular orientation.

FIG. 1 is perspective view of a "one piece" shelf tray 10 that can be used as a component of a pallet display for holding products in their primary packaging. The shelf tray 10 can be stacked on top of similar shelf trays 10 to form a multiple shelf pallet display suitable for shipping and/or displaying products. The pallet display may be wrapped in an outer wrap to protect the products from dust and damage during shipment, and carried on a standard pallet.

The shelf tray 10 comprises a bottom 22, side walls 12, end walls 14, corner posts 16 and center supports 18 The corner posts 16 and center supports 18 are the same height and support one or more shelf trays 10 stacked on top of the shelf tray 10.

Each side wall 12 extends upward from the bottom 22 and laterally from one corner post 16 to another corner post 16.

Each end wall 14 extends upward from the bottom 22 and laterally from one corner post 16 to another corner post 16.

The bottom 22 may define a central opening 28 and one or more slots 30 arranged around the central opening 28. The bottom panel 22 has a substantially rectangular periphery comprising two opposing side edges 32 and two opposing end edges 34 (obscured in FIG. 1). The bottom panel 22 may define slots 36, 37 located around its perimeter adjacent to each side edge 32.

The corner posts 16 help separate and support the shelf trays 10 above and/or a top cap (not shown). The height of the corner posts 16 is determined by the height of the products in their primary packaging or, more particularly, the desired height between shelf trays 10. Each corner post may have locator tabs 17 extending upwardly from the top edge 144 of the corner post 16. Each locator tab 17 is formed from a locator tab 72 which forms part of the tray member blank 20 and a locator tab 128 that forms part of an insert blank 90.

Similarly, the center supports 18 help separate and support the shelf trays 10 and, if present, a top cap. The height of the center supports 18 also is determined by the height of the products in their primary packaging or, more particularly, the desired height between trays 10. Each center support 18 may have tab 127 extending upwardly from the top edge 146 of the center support 18.

The shelf tray 10 is made from three blanks, a tray member blank 20 and two insert blanks 90, which will now be described.

Tray Member Blank

Figure 2:
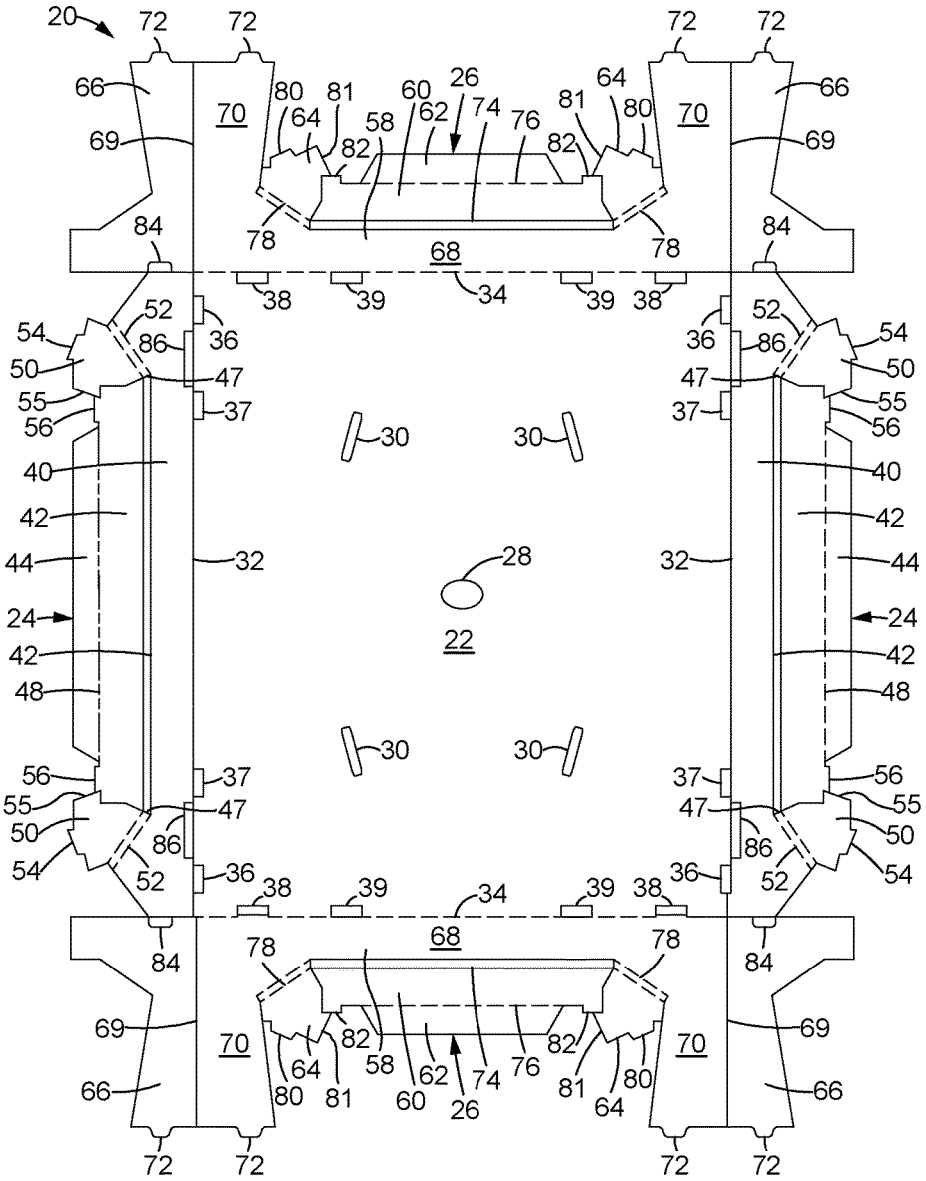
FIG. 2 is a top view of a tray member blank used to make part of the shelf tray of FIG. 1.

FIG. 2 is a top view of a tray member blank 20 used to make part of the shelf tray 10 of FIG. 1. The blank 20 may be made from any suitable material, but corrugated board is preferred for its combination of strength, light weight and recyclability. The blank 20 is shown cut and scored from a single piece of material to the desired shape, and comprises a rectangular bottom panel 22, two opposing side wall assemblies 24 and two opposing end wall assemblies 26.

The perimeter of the rectangular bottom panel 22 is defined by parallel, opposing side fold lines 32 and parallel, opposing end fold lines 34. The bottom 22 may define two or more side slots 36 (obscured in FIG. 1) adjacent each side edge 32 and two or more end slots 38 (obscured in FIG. 1) adjacent each end edge 34.

Each side wall assembly 24 extends outwardly from a side fold line 32, away from the bottom panel 22, and may comprise an outer side panel 40, an inner side panel 42, a lip 44 and two angled panels 50.

The outer side panel 40 is foldably connected to the bottom panel 22 along the side fold line 32. The inner side panel 42 is foldably connected to the outer side panel 40 along double fold lines 46. The lip 44 is foldably connected to the inner side panel 42 along a lip fold line 48. The outer side panel 40 is substantially contiguous with the bottom panel 22 along the entire length of the side fold line 32. The inner side panel 42 is shorter, being contiguous with the outer side panel 40 along the entire length of the double fold lines 46. Each outer panel may define a slot 86 adjacent to the side edge 32 for receiving a tab 93.

The angled panels 50 are foldably connected to the outer side panel 40 along angled double fold lines 52 extending from either end 47 of the double fold lines 46 away from the bottom panel 22. With the exception of the angled double fold lines 52, the fold lines 32, 46, 48 are all parallel to each other. Each angled panel 50 may be substantially irregular in shape and have one side adjacent the double fold lines 52. Each angled panel 50 may have a tab 54 extending outwardly from another side and a tab 55 extending outwardly from a third side. The tab 54 is configured to fit into a vertical slot 84 in a second I-shaped inner corner post member 102. The tab 55 is configured to fit into a slot 36 in the bottom panel 22.

Each inner side panel 42 may have a pair of tabs 56 extending outwardly and configured to fit into slots 37 in the bottom panel 22.

The two opposing end wall assemblies 26 extend outwardly from the end fold lines 34. Each end wall assembly 26 comprises an outer end panel 58, an inner end panel 60, a lip 62, two angled panels 64, and two L-shaped second outer corner post members 66. The outer end panel 58 is foldably connected to the tray bottom panel 22 along the end fold line 34.

The outer end panel 58 is substantially U-shaped and includes an elongated portion 68 that forms part of the shelf tray end wall 14 and two L-shaped first outer corner posts members 70 that extend from either end of the elongated portion 68 and form part of the corner posts 16, as explained in more detail below.

Each L-shaped first outer corner post member 70 is foldably connected to a second outer corner post member 66 along a vertical fold line 69 (also known as the outer corner edge 69). Together, the L-shaped first outer corner post member 70 and the L-shaped second outer corner post member 66 form the outer half of a corner post 16. That is, together they form the two orthogonal sides of the corner post 16 that face away from the products. Each fold line 69 is aligned (collinear) with a side edge 32 and forms an outer edge 69 of a corner post 16. A locating tab 72 may extend outwardly from each first outer corner posts member 70 and each second outer corner post member 66. The second outer corner post member 66 may define a slot 84 for receiving a tab 54.

The inner end panel 60 is foldably connected to the outer end panel 58 along double fold lines 74. The lip 62 is foldably connected to the inner end panel 60 along a fold line 76. The angled panels 64 are foldably connected to the outer end panel 58 along angled double fold lines 78. The outer end panel 58 is substantially contiguous with the bottom panel 22 along the entire length of the end fold line 34. The inner end panel 60 is shorter, being contiguous with the outer end panel 58 along the entire length of the double fold lines 74. The angled double fold lines 78 extend outwardly at an angle from either end of the double fold lines 74.

Each angled panel 64 may be substantially irregular in shape and have one side adjacent the double fold lines 78. Each angled panel 64 may have a tab 80 extending outwardly from another side and a tab 81 extending outwardly from a third side. Each tab 80 fits into a vertical slot 84 in one of the corner posts 16. Each tab 81 that fits into an end slot 38 in the bottom panel 22.

Each inner end panel 60 may have a pair of tabs 82 extending outwardly (away from the bottom panel 22) and configured to fit into end slots 38 in the bottom panel 22.

Insert Blank

Figure 3:
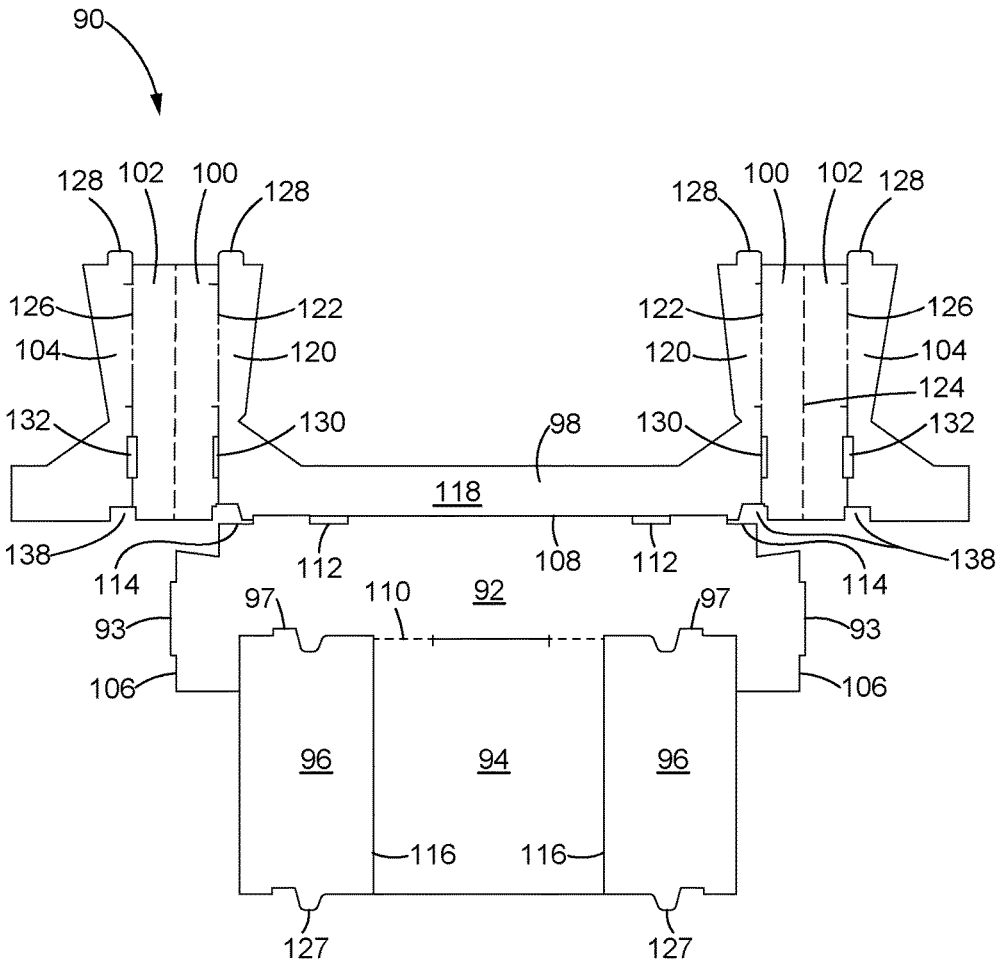
FIG. 3 is a top view of an insert blank used to make part of the shelf tray of FIG. 1.

FIG. 3 is a top plan view of a blank 90 used to make part of the shelf tray 10 of FIG. 1. The blank 90 may be made from any suitable material, but corrugated board is preferred for its combination of strength, light weight and recyclability. The blank 90 is shown cut and scored from a single piece of material to the desired shape. The blank 90 comprises a bottom panel 92, a center support main panel 94, two center support wing panels 96, an end wall panel 98, a first I-shaped inner corner post member 100, a second I-shaped inner corner post member 102 and a second L-shaped inner corner post member 104.

The bottom panel 92 may be substantially rectangular and may be defined by parallel, opposing side free edges 106 and parallel, opposing outer fold line 108 and inner fold line 110. The bottom panel 92 may define slots 112 adjacent the outer fold line 108 and configured to receive tabs 82, and slots 114 adjacent the outer fold line 108 and configured to receive tabs 80.

The center support main panel 94 may be foldably attached to the bottom panel 92 along the inner fold line 110. The center support wing panels 96 are foldably attached to the center support main panel 94 by parallel opposing fold lines 116. A tab 127 may extend outwardly from the center support wing panels 96 (in the direction away from the inner fold line 110) and may be configured to fit through a slot 30 in another shelf tray 10 or top cover.

As explained in more detail below, the center support main panel 94 and the two center support wing panels 96 can be folded along fold lines 110 and 116 to create the center support 18 shown in FIG. 1.

The end wall panel 98 is substantially U-shaped and includes an elongated portion 118 that forms part of the shelf tray end wall and two first L-shaped inner corner post members 120 that extend from each end of the elongated portion 118 and form part of the corner posts 16 as explained in more detail below.

Each first L-shaped inner corner post member 120 is foldably connected to a first I-shaped inner corner post member 100 along a vertical fold line 122. Each first I-shaped inner corner post member 100 is foldably connected to a second I-shaped inner corner post member 102 along a vertical fold line 124. Each second I-shaped inner corner post member 102 is foldably connected to a second L-shaped inner corner post member 104 along a vertical fold line 126. Together, these four components, the first L-shaped inner corner post member 120, the first I-shaped inner corner post member 100, the second I-shaped inner corner post member 102 and the second L-shaped inner corner post member 104 form the inner half of a corner post 16. That is, together they form the sides of the corner post 16 that face toward the products. A locating tab 128 may extend outwardly from each first L-shaped inner corner post member 120 and each second L-shaped inner corner post member 104. The first I shaped inner corner post member 100 may define a slot 84 for receiving a tab. Another vertical slot 132 disposed in each second I-shaped inner corner post panel 102 adjacent the vertical fold line 126 accommodates a tab 80 extending from an angled panel 64 of the tray blank 20. The first L-shaped inner corner posts member 120 and the second L-shaped inner corner post member 104 may define notches 138 along their lower edges.

Shelf Tray Assembly

Figure 4:
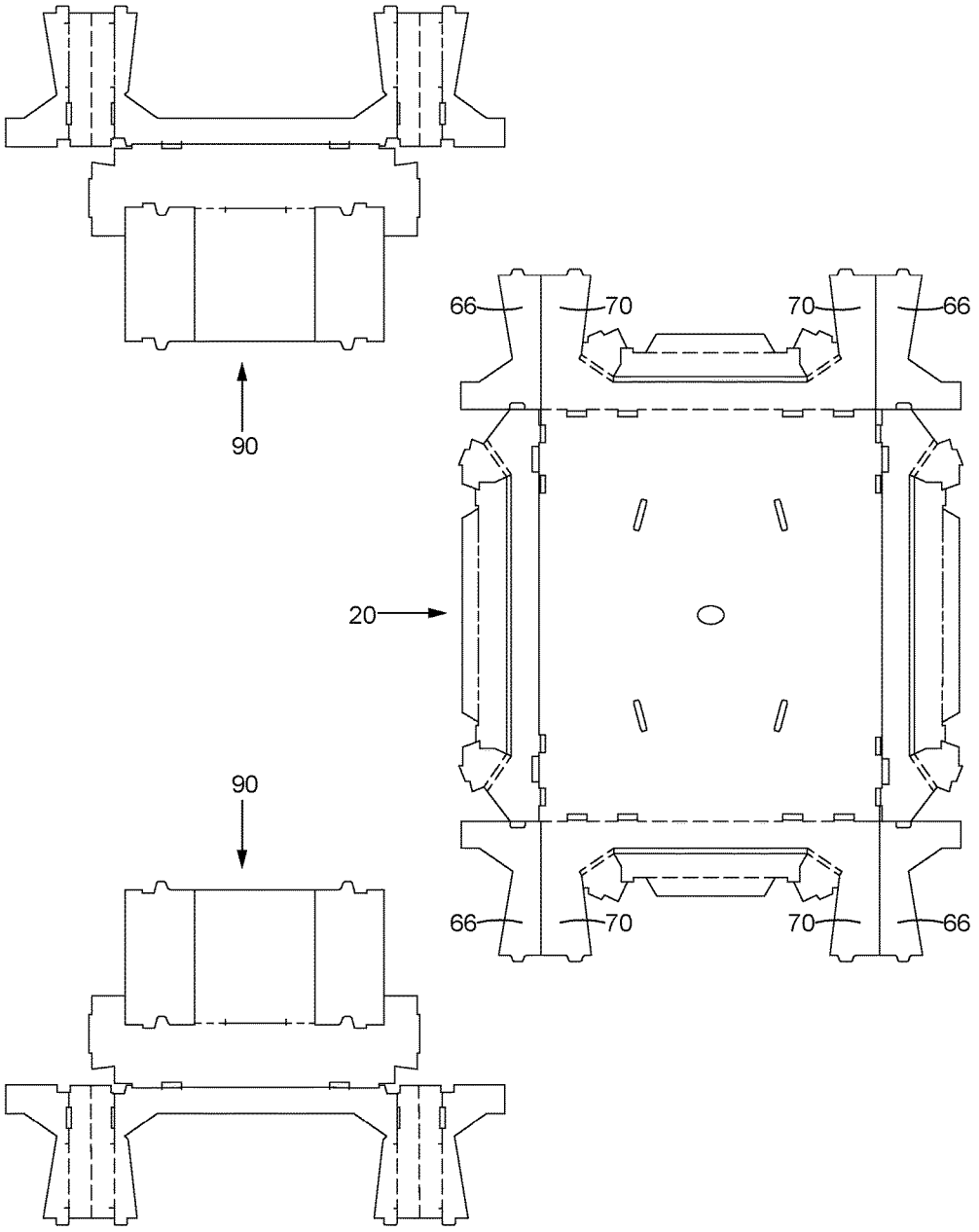
FIG. 4 is a top view of a tray member blank and two insert blanks used to make the shelf tray of FIG. 1.
Figure 5:
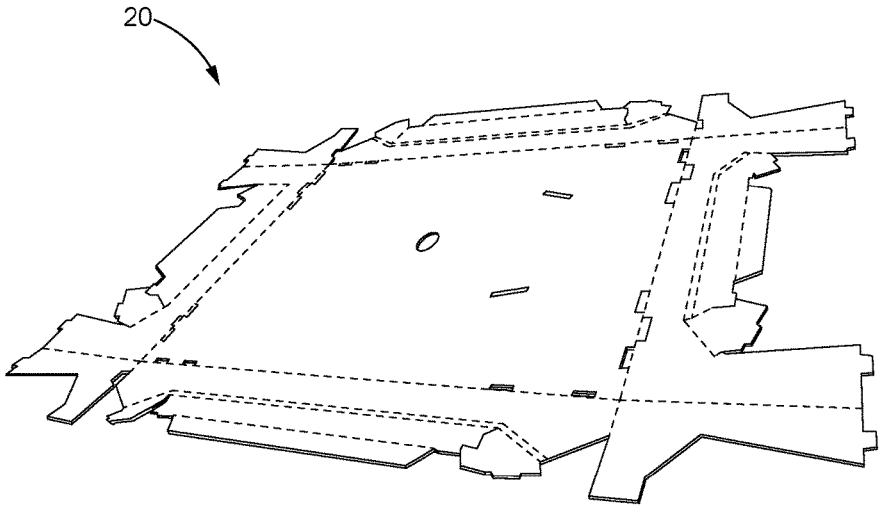
FIG. 5 is a perspective view of the tray member blank of FIG. 2.

FIGS. 4 to 14 illustrate how to assemble a shelf tray 10. As previously noted, a shelf tray 10 comprises one tray member blank 20 and two insert blanks 90. FIG. 4 is a top view of a tray member blank 20 and two insert blanks 90 ready to be used to make the shelf tray 10 of FIG. 1. FIG. 5 is a perspective view of the tray member blank 20.

Figure 6:
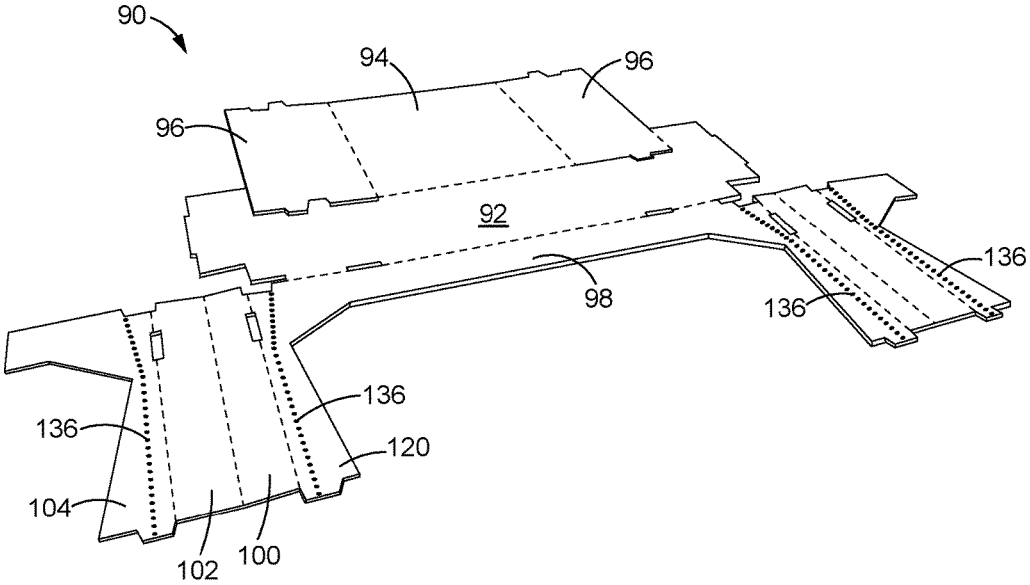
FIG. 6 is a perspective view of an insert blank like the one shown in FIG. 3 with dotted lines indicating where to apply adhesive.

As a first step, glue or other adhesive 135 is applied to each insert blank 90. FIG. 6 is a perspective view of an insert blank 90 shown with dotted lines 136 indicating where to apply adhesive 135. Preferably adhesive 135 is applied along the length (height) of each first L-shaped inner corner post member 120 and along the length (height) of each second L-shaped inner corner post member 104.

Figure 7:
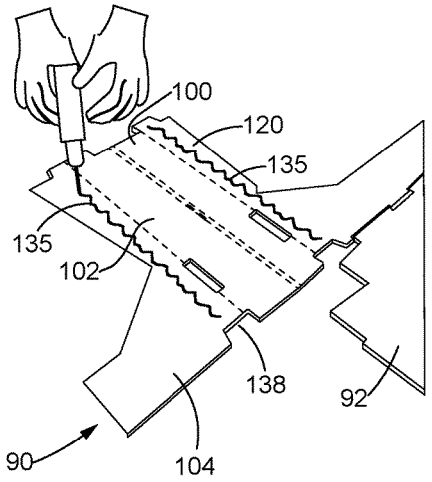
FIG. 7 is a perspective view of part of the insert blank of FIG. 6 showing adhesive being applied.
Figure 8:
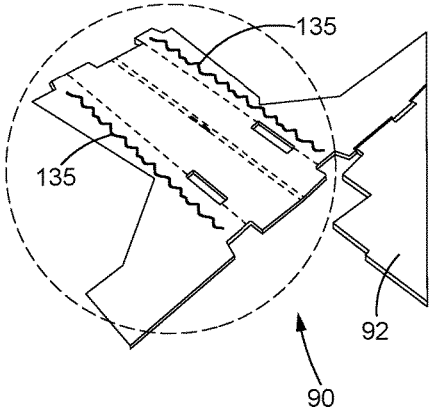
FIG. 8 is a partial perspective view of the insert blank of FIG. 7 after adhesive has been applied.

FIG. 7 is a perspective view of part of the insert blank 90 of FIG. 6 showing adhesive 135 being applied. FIG. 8 is a partial perspective view of the insert blank 90 after completion of the adhesive applying step.

Figure 9:
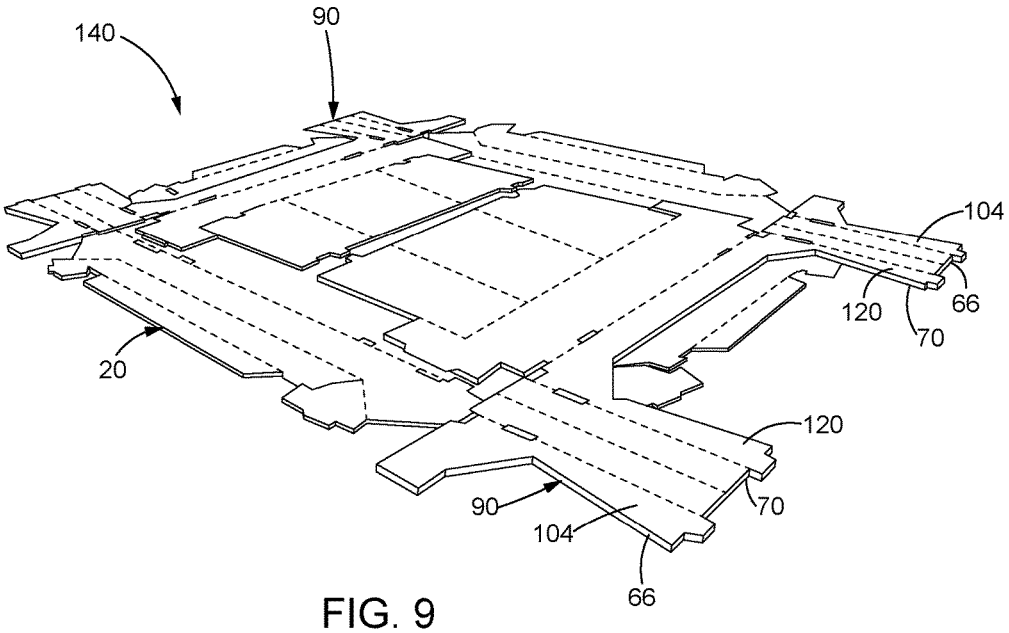
FIG. 9 is a perspective view of a tray member blank after two insert blanks have been glued onto the tray member blank, scored side down, to create a substantially flat, unfolded structure.

After the adhesive applying step, each insert blank 90 is positioned onto the tray blank 20, with the adhesive bearing inner halves of the corner posts of the insert blanks 90 aligned with and facing the outer halves of the corner posts of the tray blank 20. More specifically, the adhesive bearing surfaces of the first L-shaped inner corner post members 120 are aligned with and facing the first outer corner post members 70 of the tray blank 20, and the adhesive bearing surfaces of the second L-shaped inner corner posts members 104 are aligned with and facing the second outer corner post members 66 of the tray blank 20. FIG. 9 is a perspective view of a tray member blank 20 after two insert blanks 90 have been adhered, adhesive and scored side down, onto the tray member blank 20 to create a substantially flat, unfolded structure 140.

Figure 10:
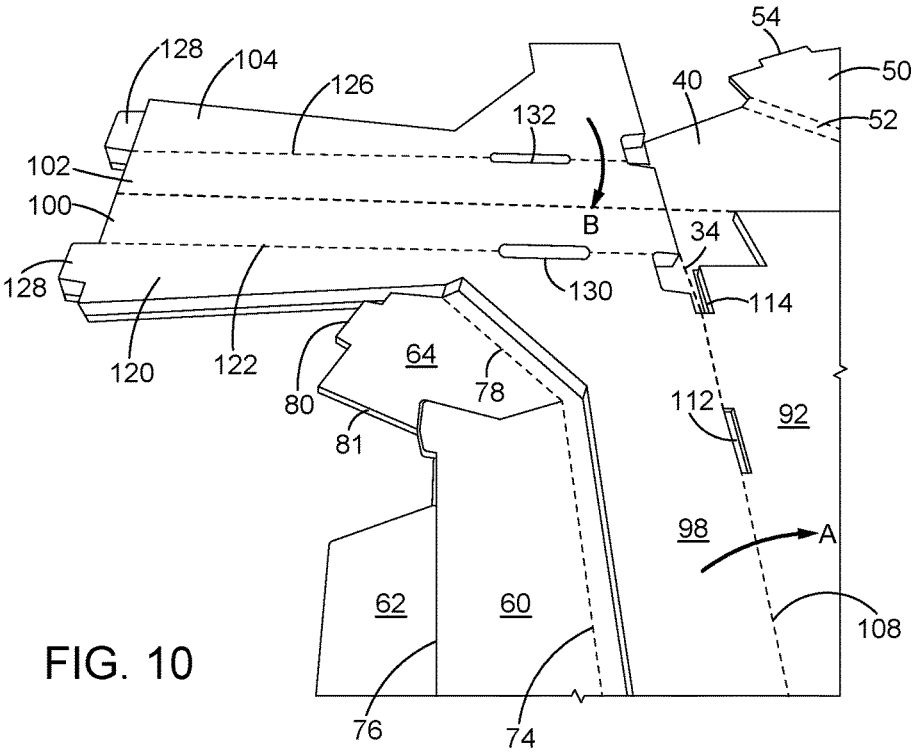
FIG. 10 is a partial perspective view of the flat, unfolded structure of FIG. 9.

Next, the flat, unfolded structure 140 may be folded inwardly along fold lines 108 and 34 (obscured under fold line 108) in the direction of arrow A in FIG. 10 and also folded inwardly along outer edge fold line 69 (obscured in FIG. 10) in the direction of arrow B. As the structure is folded along outer edge fold line 69, the first I-shaped inner corner post member 100 and the second I-shaped inner corner post member 102 "pop out" or, more precisely, extend inwardly away from the outer first outer corner post member 70 and the second outer corner post member 66 along fold line 124 until the first I-shaped inner corner post member 100, the second I-shaped inner corner post member 102, the first outer corner post member 70 and the second outer corner post member 66 form a substantially rectilinear, tubular portion 142 of a corner post 16, as shown in FIG. 11.

Figure 11:
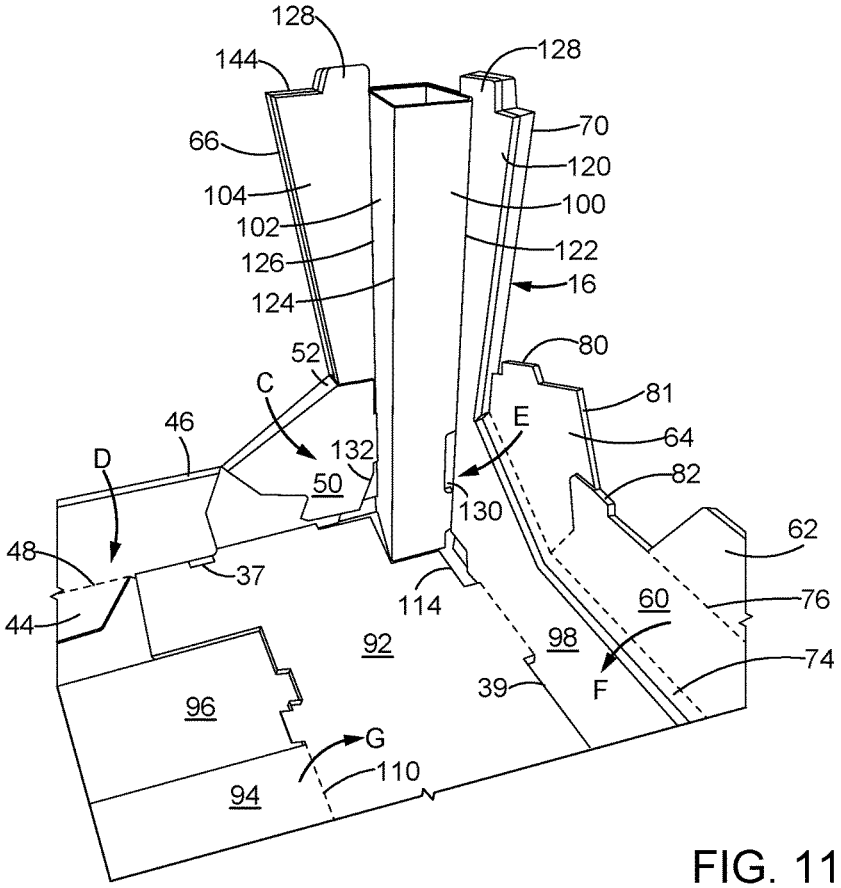
FIG. 11 is a partial perspective view of the structure of FIG. 10 shown partially folded.

FIG. 11 is a partial perspective view of the structure of FIG. 10 shown partially folded with the corner posts 16 fully assembled. Each assembled corner post 16 includes a substantially rectilinear, tubular portion 142 having two outer sides and two inner sides 100, 102. The two outer sides are formed by portions of the outer corner post members 66, 70 of the shelf tray blank 20 and are hingedly joined along the outer edge fold line 69. The two inner sides are formed by the I-shaped inner corner post members 100, 102 of the insert blank 90 and are hingedly joined along inner edge fold line 124. The corner post 16 has a top edge 144 that can abut a tray 10 or top cap resting on top.

Next, the tray side walls 12 may be finished by folding each angled panel 50 along double angled fold lines 52 as shown by the arrow C in FIG. 11 until they partially overlap the corner posts 16. As the angled panels 50 are folded over, their tabs 54 fit into the vertical slots 132 located in the corner post 16. The inner side panels 42 are folded inwardly along the double side fold lines 46 in the direction of arrow D until the inner side panels 42 are in facing, abutting relationship with the outer side panels 40 and the tabs 56 are inserted into slots 37 in the bottom panel 22. The lips 44 may be back-folded along fold lines 48 until they are in facing, abutting relationship with the bottom panel 22.

Likewise, the end wall angled panels 64 are folded along double angled fold lines 78 in the direction of arrow E until they overlap the corner posts 16. As the angled panels 64 are folded over, their tabs 80 may fit into the vertical slots 130 located in the corner post 16 and tabs 81 may fit into slots 38 in the bottom panel 22. The inner end panels 60 may be folded inwardly along the double end fold lines 74 in the direction of arrow F until the inner end panels 60 are in facing, abutting relationship with the outer end panels 58 and tabs 82 are inserted into slots 39 in the bottom panel 22. The lips 62 are back-folded along fold lines 76 until they are in facing, abutting relationship with the tray bottom panel 22.

The side wall lips 44 and end wall lips 62 may be glued or otherwise affixed to the tray bottom panel 22.

Next, the center supports 18 may be constructed by folding the center support main panel 94 upwardly along fold line 110 as shown by arrow G and then folding the center support wing panels 96 inwardly along fold lines 116 toward each other and inserting downwardly extending wing tabs 97 into the slots 30 to lock the center support wings 96 in place and form the center supports 18.

Figure 12:
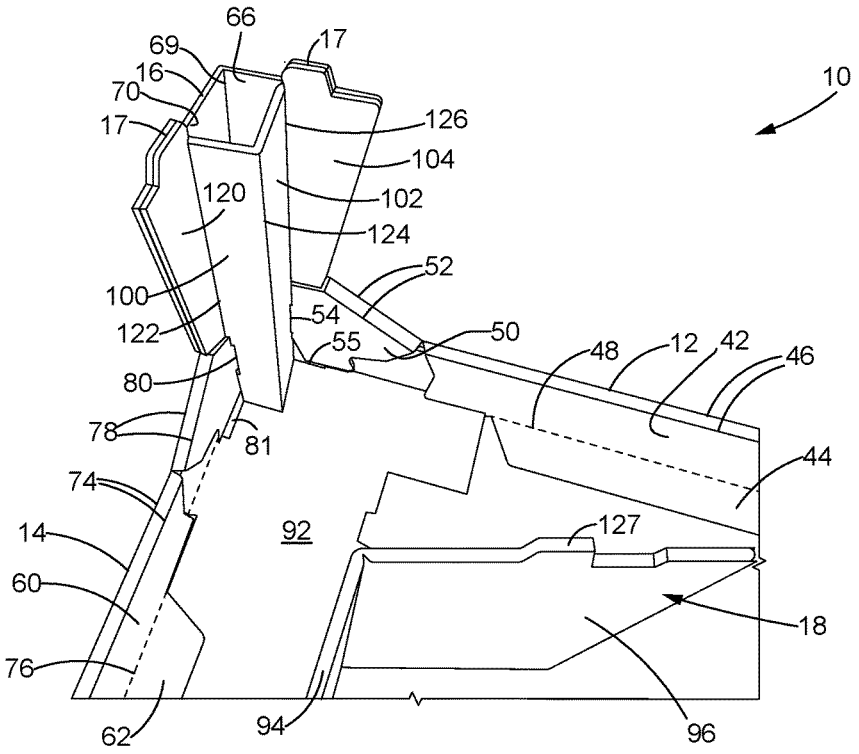
FIG. 12 is a partial perspective view of the structure of FIG. 11 shown after further folding to create a finished shelf tray.
Figure 13:
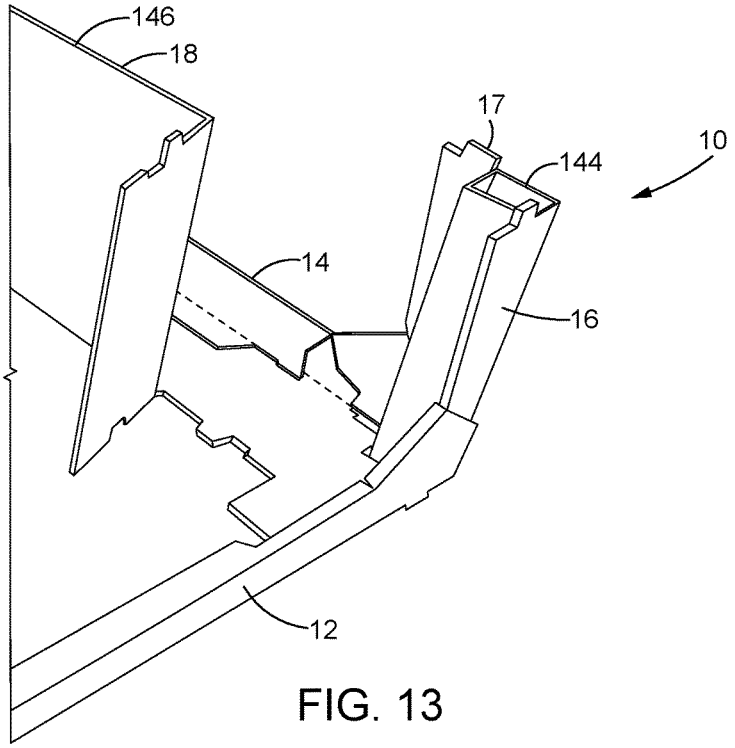
FIG. 13 is another partial perspective view of the finished shelf tray of FIG. 12.

FIG. 12 is a partial top perspective view of the structure of FIG. 11 shown after the side walls 12, end walls 14 and center supports 18 have been assembled. The shelf tray 10 is now assembled and ready to use. FIG. 13 is another partial perspective view of the finished shelf tray 10 of FIG. 12.

In particular, FIGS. 12 and 13 provide different views of one of the assembled corner posts 16. The corner post 16 comprises an outer half and an inner half. The outer half is part of the tray member blank 20 and the inner half is part of an insert blank 90.

The outer half comprises a first outer corner post member 70 and a second outer corner post member 66 connected along an outer corner edge 69. The inner half comprises a first L-shaped inner corner post member 120, a first I-shaped inner corner post member 100, a second I-shaped inner corner post member 102 and a second L-shaped inner corner post member 104. The first L-shaped inner corner post member 120 may be captured (partially encapsulated) by the angled panel 64 and the end wall 14. The second L-shaped inner corner post member 104 may be captured by the angled panel 50 and the side wall 12.

Tab 80 extends from the angled panel 64 into a slot 130 in the corner posts 16. Tab 81 extends from the angled panel 64 into a slot 112 in the insert blank 90 and may extend into the slot 38 in the tray bottom 22. Likewise, tab 54 extends from the angled panel 50 into a slot 132 in the corner post 16 and tab 55 extends from the angled panel 50 into a slot 36 in the tray bottom 22.

Figure 14:
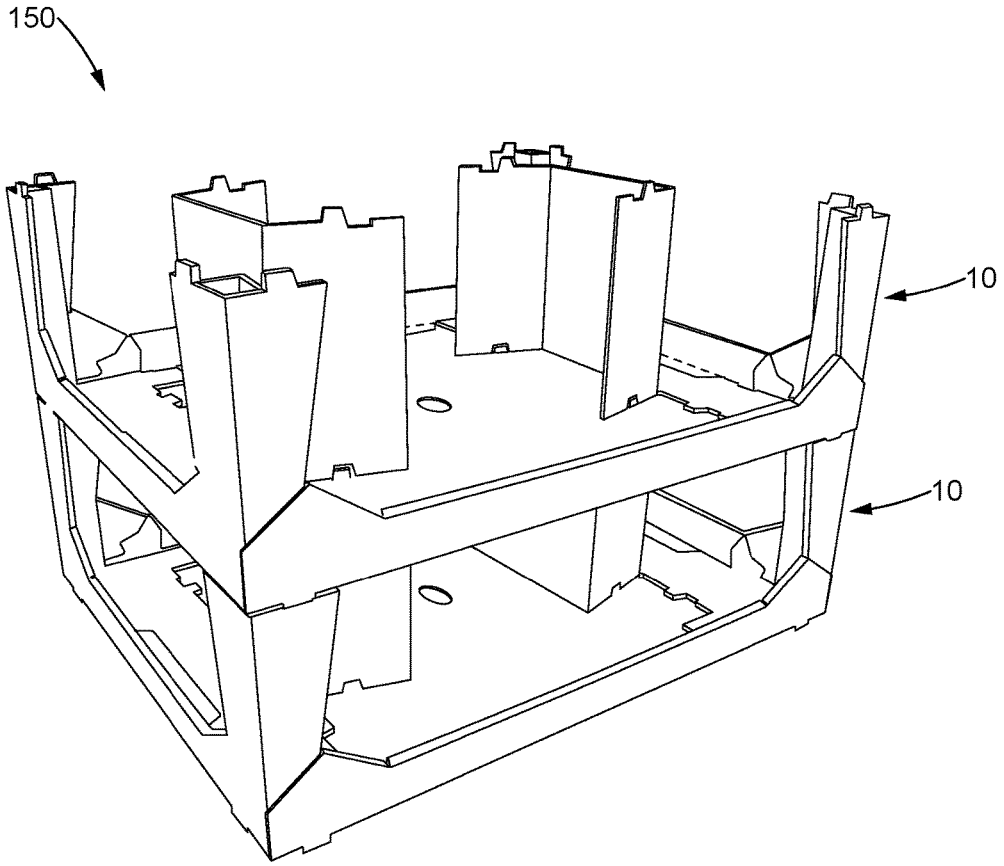
FIG. 14 is a perspective view of a display made of two shelf trays.

FIG. 14 is a perspective view of a display 150 comprising two shelf trays 10. When a second shelf tray 10 is placed on top of a first shelf tray 10, the upwardly extending corner post locator tabs 17 may fit through corresponding slots 36, 38 located in the second (upper) tray bottom 22 and into the bottom notches 138 of the corner post 16 above to help hold the two shelf trays 10 in vertical alignment. In addition, the upwardly extending center support panel locator tabs 127 may fit through corresponding slots 30 located in the shelf tray bottom 22. Additional shelf trays 10 may be placed on top until the assembled unit has the desired numbers of shelves. A top cap (not shown) may be placed over the top shelf tray 10 so that its side walls and end walls extend downward to help secure the top cap to the upwardly extending corner posts 16 by fitting the corner posts 16 snugly within the top cap side walls and end walls. The locator tabs 17 of the topmost corner posts 16 and the locator tabs 127 of the center support 18 may extend through corresponding slots in the top cap. Finally, the entire pallet display 150 may be wrapped in transparent plastic film to protect the products from dust and damage during shipment.

INDUSTRIAL APPLICABILITY

Thus there has been described a shelf tray for a pallet display for shipping and displaying products. The shelf tray and pallet display are easy to assemble from die cut blanks. The pallet display is strong enough not only to support the weight of the products on the shelf trays and withstand the vibration and impact forces that can occur during shipping, but also to withstand the weight of one or more pallet displays stacked on top. The pallet display is particularly suited for shipping and displaying irregularly shaped items or items that cannot withstand vertical stacking forces, such as soft-packaged products, since the system can bear the entire stacking load.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A shelf tray comprising:

a bottom defining one or more bottom slots, the bottom having a substantially rectangular periphery comprising two opposing side edges, two opposing end edges and four corners;

four corner posts extending upwardly from the four corners of the bottom, each corner post having a top edge and a height;

two side walls, each side wall extending upward from a side edge;

two end walls, each end wall extending upward from an end edge and laterally from one side wall to another side wall; and two center supports extending upwardly from the bottom, each center support having a top edge and a height equal to the height of the corner posts, each center support further having locator tabs extending upwardly from the top edge and configured to fit into bottom slots of a second shelf tray positioned on top of the shelf tray wherein the shelf tray comprises three separate blanks consisting of a tray blank and two insert blanks;

the bottom, end walls and side walls are formed from the tray blank;

each center support is formed from part of one of the insert blanks; and each corner post comprises an inner half formed from part of one of the insert blanks and an outer half formed from part of the tray blank.

2. The shelf tray of claim 1 wherein each corner post has locator tabs extending upwardly from the top edge of the corner post.

3. The shelf tray of claim 1 wherein each center support comprises a bottom panel in flat abutting relationship with the bottom, a main panel foldably attached to the bottom panel and extending vertically upwardly from the bottom panel, and wing panels foldably attached to the main panel by parallel opposing fold lines.

4. The shelf tray of claim 3 wherein each end wall comprises an outer end panel and an inner end panel foldably attached to each other by a double fold line, the outer end panel being foldably attached to the tray bottom panel along an end fold line.

5. The shelf tray of claim 4 further comprising an end wall panel elongated portion foldably attached to the bottom panel and captured between the end wall outer end panel and the end wall inner end panel.

6. The shelf tray of claim 1 wherein the outer half of each corner post is attached to the bottom and a comprises a first outer corner post member foldably attached to a second outer corner post member along an outer corner.

7. A shelf tray comprising:

a tray member blank comprising a bottom having a substantially rectangular periphery comprising two opposing side edges, two opposing end edges and four corners, two side walls, each side wall extending upward from a side edge, two end walls, each end wall extending upward from an end edge and laterally from one side wall to an opposing side wall, a first outer corner post member foldably attached to the bottom along an end edge and a second outer corner post member foldably attached to the first outer corner post member in an orthogonal configuration along an outer corner edge; and two insert blanks adhered to the tray blank, each insert blank comprising a bottom panel adjacent the bottom, a center support extending upwardly from the bottom panel, an end wall panel elongated portion foldably attached to the bottom panel and in flat abutting relationship with the end wall, and two corner post inner halves attached to the end wall panel elongated portion and adhered to the first outer corner post member and the second outer corner post member wherein the shelf tray comprises four corner posts; and the two corner post inner halves of each insert blank form parts of two separate corner posts.

8. The shelf tray of claim 7 wherein each center support comprises a main panel foldably attached to the bottom panel and two wing panels foldably attached to the main panel by parallel opposing fold lines; and wherein the main panel and the two wing panels of each center support are located a distance from the periphery of the tray.

9. The shelf tray of claim 7 wherein each end wall comprises an outer end panel foldably attached to the tray bottom panel along an end edge and an inner end panel foldably attached to the outer end panel along a double fold line.

10. The shelf tray of claim 9 wherein each end wall panel elongated portion is captured between the end wall outer end panel and the end wall inner end panel.

11. The shelf tray of claim 7 wherein each inner half comprises a first L-shaped inner corner post member attached to the end wall panel elongated portion and adhered to the first outer corner post member, a first I-shaped inner corner post member foldably attached to the first L-shaped inner corner post member along a vertical fold line, a second L-shaped inner corner post member adhered to the second outer corner post member, and a second I-shaped inner corner post member foldably attached to the second L-shaped inner corner post member along a vertical fold line, the second I-shaped inner corner post member foldably attached to the first I-shaped inner corner post member along an inner edge.

12. The shelf tray of claim 7 wherein each bottom defines one or more bottom slots and each center support further comprises tabs extending upwardly from the center support and configured to fit within the bottom slots of a second shelf tray positioned on top of the shelf tray.

13. A method of making a shelf tray comprising the steps of:

providing a tray member blank comprising a bottom having a substantially rectangular periphery comprising two opposing side edges, two opposing end edges and four corners, two side walls, each side wall extending from a side edge, two end walls, each end wall extending from an end edge and from one side wall to an opposing side wall, a first outer corner post member foldably attached to the bottom and a second outer corner post member foldably attached to the first outer corner post member along an outer corner edge;

providing two insert blanks, each insert blank comprising a bottom panel, a center support extending from the bottom panel, an end wall panel elongated portion foldably attached to the bottom panel, and two corner post inner halves attached to the end wall panel elongated portion;

positioning each insert blank onto the tray blank so that each first L-shaped inner corner post member is aligned with and adhered to a corresponding first outer corner post member and each second L-shaped inner corner post member is aligned with and adhered to a corresponding second outer corner post member to create a substantially flat, unfolded structure;

folding the flat, unfolded structure inwardly along the two opposing end edges and along the four outer corner edges;

allowing the first I-shaped inner corner post member and the second I-shaped inner corner post member to extend inwardly away from the outer first outer corner post member and the second outer corner post member along fold line until the first I-shaped inner corner post member, the second I-shaped inner corner post member, the first outer corner post member and the second outer corner post member form a substantially rectilinear, tubular portion of a corner post;

folding each inner end panel inwardly along the double end fold line until the inner end panel is in facing, abutting relationship with a corresponding outer end panel and each insert blank is captured therebetween;

folding each center support main panel upwardly along fold line; and folding each center support wing panel inwardly along fold line to achieve a fully assembly shelf tray.

* * * * *